US009458066B2

(12) United States Patent
Goodridge et al.

(10) Patent No.: US 9,458,066 B2
(45) Date of Patent: Oct. 4, 2016

(54) PROCESS FOR THE PRODUCTION OF INTERMEDIATE EMULSIONS FOR USE IN EMULSION EXPLOSIVES

(75) Inventors: Richard John Goodridge, Redhead (AU); Vladimir Sujansky, East Burwood (AU); Ivan Junarsa, Macquarie Hills (AU); Kira McGrath, Coal Point (AU)

(73) Assignee: ORICA INTERNATIONAL PTE LTD, Singapore (SG)

( * ) Notice: Subject to any disclaimer, the term of this patent is extended or adjusted under 35 U.S.C. 154(b) by 405 days.

(21) Appl. No.: 13/816,543

(22) PCT Filed: Aug. 12, 2011

(86) PCT No.: PCT/AU2011/001037

§ 371 (c)(1),
(2), (4) Date: Apr. 16, 2013

(87) PCT Pub. No.: WO2012/019245

PCT Pub. Date: Feb. 16, 2012

(65) Prior Publication Data

US 2013/0327456 A1 Dec. 12, 2013

(30) Foreign Application Priority Data

Aug. 13, 2010 (SG) ..... 201005918

(51) Int. Cl.
*C06B 31/00* (2006.01)
*C06B 31/28* (2006.01)
(Continued)

(52) U.S. Cl.
CPC ..... *C06B 31/285* (2013.01); *B01F 3/0807* (2013.01); *B01F 5/0604* (2013.01); *B01F 13/0059* (2013.01); *C06B 21/0008* (2013.01); *C06B 47/145* (2013.01); *B01F 2003/0849* (2013.01)

(58) Field of Classification Search
USPC ..... 149/46, 45, 108.8, 109.6
See application file for complete search history.

(56) References Cited

U.S. PATENT DOCUMENTS 4,472,215 A * 9/1984 Binet ..... B01F 5/102 149/109.6
4,491,489 A * 1/1985 Ellis ..... C06B 21/00 149/109.6

(Continued)

FOREIGN PATENT DOCUMENTS

EP 1 913 994 A2 4/2008

OTHER PUBLICATIONS

"Blasting Specialist Handbook", International Society of Explosives Engineers, (2008) pp. 71-72. with English translation.

(Continued)

*Primary Examiner* — James McDonough
(74) *Attorney, Agent, or Firm* — Birch, Stewart, Kolasch & Birch, LLP

(57) ABSTRACT

A process for producing an intermediate emulsion comprising an oxidizer solution, fuel and emulsifier, which process comprises the steps of: (a) mixing in a micromixer an oxidizer solution with a fuel blend comprising a fuel and an emulsifier so as to solubilize a portion of the oxidizer solution in the fuel blend to produce a precursor product; (b) mixing the precursor product obtained in step (a) using a micromixer in one or more successive stages in order to form the intermediate emulsion.

8 Claims, 5 Drawing Sheets

(51) Int. Cl.

| | |
|---|---|
| ***D03D 23/00*** | (2006.01) |
| ***D03D 43/00*** | (2006.01) |
| ***B01F 3/08*** | (2006.01) |
| ***B01F 5/06*** | (2006.01) |
| ***B01F 13/00*** | (2006.01) |
| ***C06B 21/00*** | (2006.01) |
| ***C06B 47/14*** | (2006.01) |

(56) References Cited

U.S. PATENT DOCUMENTS

| | | | | |
|---|---|---|---|---|
| 8,257,523 | B1 * | 9/2012 | Puszynski | C06B 21/0008 149/108.2 |
| 2007/0277916 | A1 * | 12/2007 | Halander | C06B 21/0008 149/109.6 |
| 2008/0081642 | A1 * | 4/2008 | Xu | H04H 20/12 455/456.5 |
| 2008/0081842 | A1 | 4/2008 | Ueyama et al. | |

OTHER PUBLICATIONS

Star Laminator, Starlam Group Class-30, -300, -3000, -30000, pp. 50-53; http://www.microinnova.com/microreactorpdf/Star_Laminator_Microreactor.pdf.

Xuguang, "Emulsion Explosives", Metallurgical Industry Press, Beijing (1994) p. 171.

PCT/ISA/210—International Search Report mailed on Sep. 14, 2011, issued in PCT/AU2011/001037.

Charpentier, "Modern Chemical Engineering in the Framework of Globalization, Sustainability, and Technical Innovation", Ind. Eng. Chem. Res, vol. 46 (2007) pp. 3465-3485.

Eurasian Office Action issued in Eurasian Patent Application No. 201390231 on Nov. 27, 2015.

Extended European Search Report issued in European Patent Application No. 11815921.9 on Nov. 27, 2015.

* cited by examiner

PROCESS FOR THE PRODUCTION OF INTERMEDIATE EMULSIONS FOR USE IN EMULSION EXPLOSIVES

FIELD OF THE INVENTION

The present invention relates to the production of components useful in the manufacture of emulsion explosives, and to emulsion explosives manufactured from such components. The invention also relates to mixing apparatus suitable for use in practice of the invention.

BACKGROUND TO THE INVENTION

Emulsion explosives used in commercial blasting operations are typically formed by mixing an emulsion comprising an aqueous solution of an oxidizer, a fuel and an emulsifier (hereafter referred to as an "intermediate emulsion") with a suitable sensitising additive that renders the emulsion detonable. The result is a sensitised emulsion explosive. The intermediate emulsion is generally a high internal phase water-in-oil emulsion containing droplets of an oxidizer solution emulsified in a fuel.

Intermediate explosives and sensitised emulsion explosives are well known and described in the art. For example, U.S. Pat. No. 3,447,978 is master patent reference describing emulsions in term of individual components of emulsion blasting agents (non detonator sensitive), U.S. Pat. No. 4,149,917 is master patent reference for detonator sensitive emulsion blasting agents and U.S. Pat. No. 4,138,281 is the first patent describing emulsion manufacturing process of packaged detonator sensitive emulsions.

In order to achieve economies of scale and efficiencies the intermediate emulsion is usually manufactured in bulk at a centralised, dedicated facility and transported to the site of intended use or to a specialist plant for blending up as an emulsion explosive. That location may well be remote and quite possibly in a different country from where the intermediate explosive is manufactured.

Furthermore, with transportation in mind, the intermediate explosive is made to meet the UN non-explosive hazard classification. This requires the intermediate explosive to include a relatively large amount of water in the formulations. The water-diluted intermediate emulsions, besides being classified as non-explosive (Oxidizer class 5.1) also exhibits reduced sensitivity & explosives energies.

This manufacture and supply chain model has been commercially successful but, in recent times, there has been cause to reconsider it due to regulations relating to the security associated with manufacture and transport of explosives and explosives components.

It is also evident the process of supply and delivery of intermediate emulsions creates limitations and constraints in the applications on the customer sites. This is because due to varying customer needs, it is not easy to achieve specific performance characteristics, such as detonator sensitivity or high energy of the explosive products.

Against this background it would be desirable to be able to manufacture the intermediate emulsion and a corresponding emulsion explosive with suitably high performance on-site at the location of intended end use. However, this alternative approach is by no means straight forward as it brings with it various other practical issues. For example, the location of intended use can be remote and not easily accessible. Accordingly, it may not be feasible to transport and install large and/or complex manufacturing componentry. Any proposed local (on-site) manufacture will also need to have a suitably high production rate to cope with usage demand, and product quality must also be consistently high and predictable.

SUMMARY OF THE INVENTION

The present invention seeks to meet these needs by manufacture of an intermediate emulsion using micromixer (sometimes also referred to as a microstructured mixer) technology. Using currently available micromixers it is not believed to be possible to form such an emulsion from its constituent components in a single mixing step. However, in accordance with the present invention it has been found that successive stages of mixing can be employed to achieve an intermediate emulsion having suitable characteristics.

Accordingly, in one embodiment the invention provides a process for producing an intermediate emulsion comprising an aqueous oxidizer solution, fuel and emulsifier, which process comprises the steps of:

(a) mixing in a micromixer an aqueous oxidizer solution with a fuel blend comprising a fuel and an emulsifier so as to solubilise a portion of the oxidizer salt solution in the fuel blend to produce a precursor product;

(b) mixing the precursor product obtained in step (a) using a micromixer in one or more successive stages in order to form the intermediate emulsion.

In the context of the present invention the intermediate emulsion that is produced is of conventional kind and it has conventional characteristics in terms of volumetric ratios of internal dispersed phase to external continuous phase, viscosity, stability etc. The components used to produce the intermediate emulsion are also conventional and one skilled in the art would be familiar with components that may be used and their typically used proportions.

The present invention also relates to the manufacture of an emulsion explosive by suitable sensitisation of an intermediate emulsion produced in accordance with the invention.

The present invention also relates to the use of such an emulsion explosive in a blasting operation. The emulsion explosive is used in conventional manner and detonated using conventional means.

The present invention also provides mixing apparatus suitable for producing an intermediate emulsion in accordance with the present invention, the apparatus comprising a micromixer capable of producing a precursor emulsion as described herein, and one or more further micromixers for converting the precursor emulsion into an intermediate emulsion as described herein. The design of suitable micromixers for use in the apparatus is described in more detail later. The individual micromixers may be provided in the same housing, but this is not essential. The function and working inter-relationship of the micromixers is central to the present invention.

The present invention also provides an array of such mixing apparatus arranged in parallel in order to achieve scale-up in production of the intermediate emulsion using the principles of the present invention.

As will be explained, one advantage of the methodology of the present invention is that it may be applied to produce intermediate emulsions having a range of intrinsic sensitivities. It may be possible in accordance with the present invention to produce emulsions that require very little, if any, sensitisation in order to render them useful in blasting operations.

DETAILED DISCUSSION OF THE INVENTION

The key to the present invention is the stage-wise and successive mixing of components using micromixers to produce an intermediate emulsion having desirable characteristics.

The first stage of mixing is intended to achieve solubilisation (dissolution) of a portion of the oxidizer solution in the fuel blend (of fuel and emulsifier). In this regard it is understood that emulsifier molecules form micellar solution (fuel blend) that comprises a dispersion of micelles of emulsifier in the fuel solvent. Micelles consist of aggregated amphiphiles, and in a micellar solution these are in equilibrium with free, un-aggregated amphiphiles. Micellar solutions form when the concentration of amphiphiles exceed the critical micellar concentration (in the present invention this is always the case). It is believed that during mixing only un-aggregated, free micelles are available to stabilize the oxidizer droplets formed during the first stage of mixing. The free micelles arrange themselves on the surface of oxidizer solution droplets according to energetically favourable hydrophobic and hydrophilic interactions with respective aqueous and organic phases.

The first stage of mixing solubilises only a portion of the oxidizer solution that is available based on the intended ratio of oxidizer to fuel components. This is because this stage of mixing is of relatively low energy and does not impart sufficient shear and turbulence to provide additional solubilisation of the oxidizer solution in the fuel blend and thus emulsion formation. This is due to failure of the mixer to break the aggregated micelles and make them free (available) for the oxidizer droplet stabilization. Indeed, no single micromixer apparatus is believed to be available that would achieve this. The first stage of mixing preferably involves contacting of thin lamellae of oxidiser solution and fuel blend which are subsequently mixed through diffusion mixing and the micromixer is designed accordingly.

The process of the invention is intended to be run continuously as between respective mixing stages. However, the principles underlying the invention may be understood by analysing the output from the first stage of mixing. The precursor material produced in the first stage has no emulsion stability to speak of and settles quickly into relatively discrete phases. The material does include droplets of oxidizer solution in an oil phase but it is evident that a significant portion of the oxidizer solution remains largely unmixed with the fuel blend.

The precursor material is delivered directly (and without delay) to another downstream micromixer that imparts increased shear into the stream. Depending on design and mixing efficacy, it is possible to use one or more such micromixers. If multiple downstream micromixers are employed, these are arranged in series to achieve successive mixing stages.

Irrespective of the number of micromixers involved after the first stage of mixing, the intention is to form a stable emulsion having desired characteristics by applying shear stress to the precursor material produced in the first stage. Without wishing to be bound by theory it is believed that the free oxidizer solution in the precursor material is caused to fragment due to hydrodynamic instabilities created by shear stress and then decays into regular droplets. It is also believed that in the same shear field the aggregated micelles are broken down into free micelles of emulsifier that are instantaneously available to stabilize the newly formed surface of the oxidizer droplets. At suitable flow rates relatively small and emulsifier stabilized droplets of oxidizer solution are produced, thereby resulting in formation of a stable emulsion. In other words, the micromixing after step (a) ensures conversion of what is effectively fluid flow energy in the first step of mixing into shear energy. The first step of mixing does not provide enough energy to achieve the necessary dispersion of oxidizer solution in the fuel phase and also the necessary de-aggregation of micelles to achieve emulsion formation, although important structural changes are achieved that facilitate emulsion formation by subsequent micromixing. The invention relies on the interrelationship between the various steps of mixing in order to achieve the desired result.

The overall philosophy of the invention is to apply micromixing to each stage/step of production of an intermediate emulsion. In the context of the present invention this is advantageous for a number of reasons as follows.

- Micromixers provide enhanced heat transfer due to the fact that the surface area of mixer componentry in contact with materials being mixed is large whereas the volume of materials being mixed is relatively low.
- The length scale of the mixing process is very short and hence efficient mixing can be achieved over a very short period of time, typically milliseconds. Note: This only means that micromixers are more efficient than conventional mixers.
- Scaling up of manufacturing output is possible by utilising multiple production streams arranged in parallel.
- Micromixers are invariably small and compact devices that are easily transported, and can be set up with relative ease. Ancillary components are required, such as metering pumps and the like, but these do not introduce complexity or implementation difficulties.

The present invention can advantageously be applied to produce intermediate emulsions that have a range of inherent sensitivity. Thus, the invention may be applied to produce emulsions that are intrinsically insensitive through to emulsions that are intrinsically sensitive to a shock or mechanical stimuli. This will be a function of the nature of the dispersed oxidizer phase. The oxidizer phase may vary from water diluted oxidizer salt solutions up to very concentrated solutions with negligible amount of water or to oxidizers that are based on molten salts and eutectic explosive fluids. In relation to producing intrinsically shock or mechanically sensitive emulsions the following advantages of using micromixers are also particularly relevant:

- Micromixing involves mixing relatively small volumes of individual components. In the context of making explosives materials, this is attractive from a safety perspective. Indeed, due to the size scale of micromixers the mass of potentially explosive material that is undergoing mixing is very small and well below the critical mass for detonation. Moreover, it is known that a detonation will not propagate in the kind of small diameter microchannels typically used in micromixers (because the microchannels are usually smaller than the critical diameter for detonation). This makes the process of the invention inherently safe.
- Mixing on a small scale allows close control and thus permits high shear rates and heat removal, and lower operating pressures in some cases.
- Mixing on a small scale ensures a relatively small amount of explosive inventories in the manufacturing plant.

In terms of process parameters, typically the output of each stage of mixing, and of the process as a whole, is typically 50 to 125 ml/min. The residence time for the entire process is short and is generally from 20 to 100 milliseconds. Over each stage of mixing it is desirable for the micromixer design to achieve efficient conversion of fluid flow energy into shear stress while maintaining a relatively low overall pressure drop. Desirably, the pressure drop for the process as a whole is less than 20 bar.

The first step of the process of the invention involves mixing an aqueous oxidizer solution with a fuel blend comprising a fuel and suitable emulsifier. The aqueous oxidizer solution and fuel blend will be metered into a suitable micromixer at flow rates based on the required ratio of these components in the final emulsion to be produced. The latter is generally a high internal phase water-in-oil emulsion so that the rate of supply of the aqueous oxidizer solution will be somewhat higher than the rate of supply of the fuel blend. The desired output rate for this first stage of mixing will also influence the rate of supply of the individual components for mixing. By way of example the volume supply rates for the aqueous oxidizer solution and fuel blend respectively may be 10 to 250 ml/min and 0.5 to 25 ml/min, preferably 30 to 150 ml/min and 3 to 15 ml/min, more preferably 50 to 125 ml/min and 5 to 12.5 ml/min.

In the first stage of mixing the flow rates of the components to be mixed may need to be adjusted so that a precursor material as required is produced. The aqueous oxidizer solution and fuel blend are not easily mixed by a laminar diffusion mixing because the miscibility of the aqueous and the fuel phase strongly depends on the micellar arrangement of the surfactant in the fuel phase.

In the present invention the amount of emulsifier must be always higher than the critical micelle concentration in order to ultimately ensure formation of a stable emulsion. In the case of emulsifier concentration being less that critical micelle concentration it is not possible to form a stable emulsion system, regardless of the shear energy and shear application time.

The fuel phase of the present invention consists of micellar solution that comprises a dispersion of aggregated micelles that are always in equilibrium with free, un-aggregated micelles. In order to form satisfactory stable emulsions the mixing must be energetic enough to disperse the aggregated micelles to make them free and available for stabilization of newly formed oxidizer droplets. At high flow rates there is likely to be segregation of immiscible fluid sheaths with the result being little or no emulsion diffusion mixing and also because of limited concentration of free micelles available. At low flow rates there may be increased diffusion mixing performance (for a given micromixer design) but it is not possible to form in a single step a high internal phase emulsion having the requisite characteristics. The reason being that there is only limited energy in diffusion mixing to simultaneously form droplets and also disperse the all aggregated micelles and in the process form a stable emulsion. The precursor is formed on the basis of the system utilizing only free, un-aggregated emulsifier micelles. Hence, there is no effective droplet stabilization due to aggregated micelles being unavailable to coat the newly formed oxidizer droplet surfaces.

After formation of the precursor, the material is subjected to further mixing in one or more successive stages. This leads to formation of an intermediate emulsion having desirable characteristics.

After formation it is important that the precursor material is subjected to further mixing before any significant change in the characteristics of the precursor material. In practice once formed the precursor material is delivered directly into an associated micromixer where further mixing is conducted. It is believed that in the new shear field the aggregated micelles are broken down into free micelles of emulsifier that are instantaneously available to stabilize the newly formed surface of the oxidizer droplets. If two or more stages of mixing are employed, the output of each respective step is usually delivered directly to the next step to avoid any possible changes in the characteristics of the product between successive stages of mixing.

The intermediate emulsion that is produced will typically have viscosity of at least 6,000 cP (Brookfield viscosity taken with spindle #7 at 50 rpm) at ambient temperature (20-25° C.). Generally the viscosity may be as high as 50,000 cP, for example, 20,000 cP at ambient temperature (Brookfield viscosity taken with spindle #7 at 50 rpm). The droplet size of the emulsion is typically less than 40 μm and the droplet size shows low polydispersity. The intermediate emulsion is also stable and compares well in this regard to corresponding emulsions prepared using conventional techniques.

In the following the principles of the present invention are described with reference to particular designs for achieving mixing as required in accordance with the invention. The particular designs that are described have been found to be particularly suitable for forming an intermediate emulsion in accordance with the invention. However, the invention should not be understood as being limited to these particular designs, and other designs are possible.

In accordance with an embodiment of the invention the first stage of mixing (to produce a precursor material) can be carried out using a "star laminator" micromixer available from Institüt für Microtechnik Mainz GmbH (IMM). The basis for these mixers is the alternating injection of two (or more) fluid streams into one flow-through mixing chamber whose geometric design can induce secondary effects. Using interdigital structures, multilamination of streams can be obtained in the laminar flow region. The two liquids to be mixed enter one cylindrical channel via star-shaped feeding structures which are incorporated in circular, thin foils. To obtain lamination in the feeding structures without premixing at least one sealing foil is required. By adjusting the size of the cylindrical inner mixing channel and the planned throughput turbulent flow of fine, alternating injected fluid flows, the corresponding mixing mechanism can be predicted.

In accordance with this embodiment formation of a precursor material can be achieved using a star laminator micromixer. Specifically, a Star Laminator 30 model mixer available from IMM may be used. This comprises a stack of stainless steel microstructured foils each having a thickness of about 25 μm. The foils have channels cut through them (using a laser) to provide a microstructured design. A total of 100-260 foils are stacked on top of each other in a steel housing. The resultant stack arrangement feeds oxidizer salt solution and fuel blend into a main mixing channel in the centre of the stack arrangement. The result of mixing is a precursor material as described.

In accordance with this embodiment of the invention this precursor material can then be subjected to further mixing by feeding it through another micromixer. In one particular design, the latter achieves further mixing by switching flow velocity periodically while decreasing the diffusion path of each phase. In this micromixer the precursor material is subjected to mixing by periodical, alternating switches of flow from a high flow velocity to a low flow velocity In this way, it is believed that pulsation of flow of the whole stream (of precursor material) promotes mixing. A variety of micromixer designs may be employed to achieve this. In accordance with the invention it has been found that the following arrangement may be suitable in this regard.

The micromixer that receives the precursor material may comprise a stack of stainless steel foils of constant dimension. Typically the foils are circular but this is not mandatory. One orifice is usually provided in each foil. In use the precursor material is caused to flow through a channel or channels defined by these orifices in a stack of foils. The flow velocity can be varied periodically by suitable arrangement of foils and orifices noting that the flow velocity through a small orifice channel will be higher than through a channel of equal length but having a larger orifice. By varying the diameter and length of the orifice, the number of orifices and the channel length for a given orifice diameter, the characteristics of the product of mixing can be manipulated. Herein this kind of mixer is referred to as a micro-orifice mixer.

By way of example, the stack arrangement in the micro-orifice mixer may be made up of three different types of foil. Each foil may be circular with the same diameter and each having a single, central orifice/opening. Typically, the foil is about 2 cm in diameter. One foil has a thickness of 50 μm and an orifice/opening diameter of 500 μm, the others have a thickness of 3.5 or 7 mm and an orifice/opening diameter of 2.2 mm. Providing a stack of foils with the same characteristics will define a flow channel having a particular diameter (corresponding to the orifice diameter) and length (corresponding to the thickness of each foil multiplied by the number of foils in the stack). By appropriate arrangement of stacks of respective foils it is possible to produce an overall stack arrangement in which the flow channel dimensions varies periodically. The result is that precursor material flowing through the stack will be subjected to a cycle of different flow velocities, thereby causing mixing by shear. By manipulating the various parameters of the stack, the characteristics of the product of mixing (output of the stack) can be manipulated. This may yield an intermediate emulsion of desired characteristics, or the product of mixing may be subjected to further mixing (refinement) in one or more subsequent steps in order to achieve those desired characteristics.

In accordance with the invention there is also provided an apparatus for producing an intermediate emulsion by the principles described herein. In simple and general terms the apparatus comprises a micromixer capable of producing a precursor material as described from mixing an oxidizer salt solution and fuel blend (fuel plus emulsifier), and one or more further micromixers that are adapted to subject the precursor material to further mixing so as to produce an emulsion blasting agent. The components of the apparatus may be provided in a single housing or arranged in series as individual units. As will be appreciated from the discussion of FIG. 1 below, the apparatus will invariable have associated componentry, such as supply tanks for oxidizer solution and fuel blend, valves, filters, pumps and metering devices.

BRIEF DESCRIPTION OF DRAWINGS

Embodiments of the invention are illustrated with reference to the accompanying non-limiting drawings in which:

FIG. 1 shows an arrangement of components suitable for implementing the present invention. The individual components for mixing are stored in a fuel blend tank (1) and oxidizer solution tank (2). These components may be heated as required using water heaters (3). When mixing is required the individual components are delivered through respective valves (4) via filters (5) to pumps (6, 7) which pump the components through mass flow meters (8) and check valves (9). These devices ensure that the correct ratio of components is supplied for initial mixing.

In the embodiment shown a precursor material is formed by mixing the components using a star laminator pre-mixer (10). The outlet of that mixer feeds precursor material directly into a micro-orifice mixer (11) where the precursor material is further mixed and an intermediate emulsion having desired characteristics is tapped off from an outlet (12). It will be appreciated that the star laminator mixer and/or micro-orifice mixer may be replaced by functionally equivalent mixer(s) of difference design.

Figure 1:
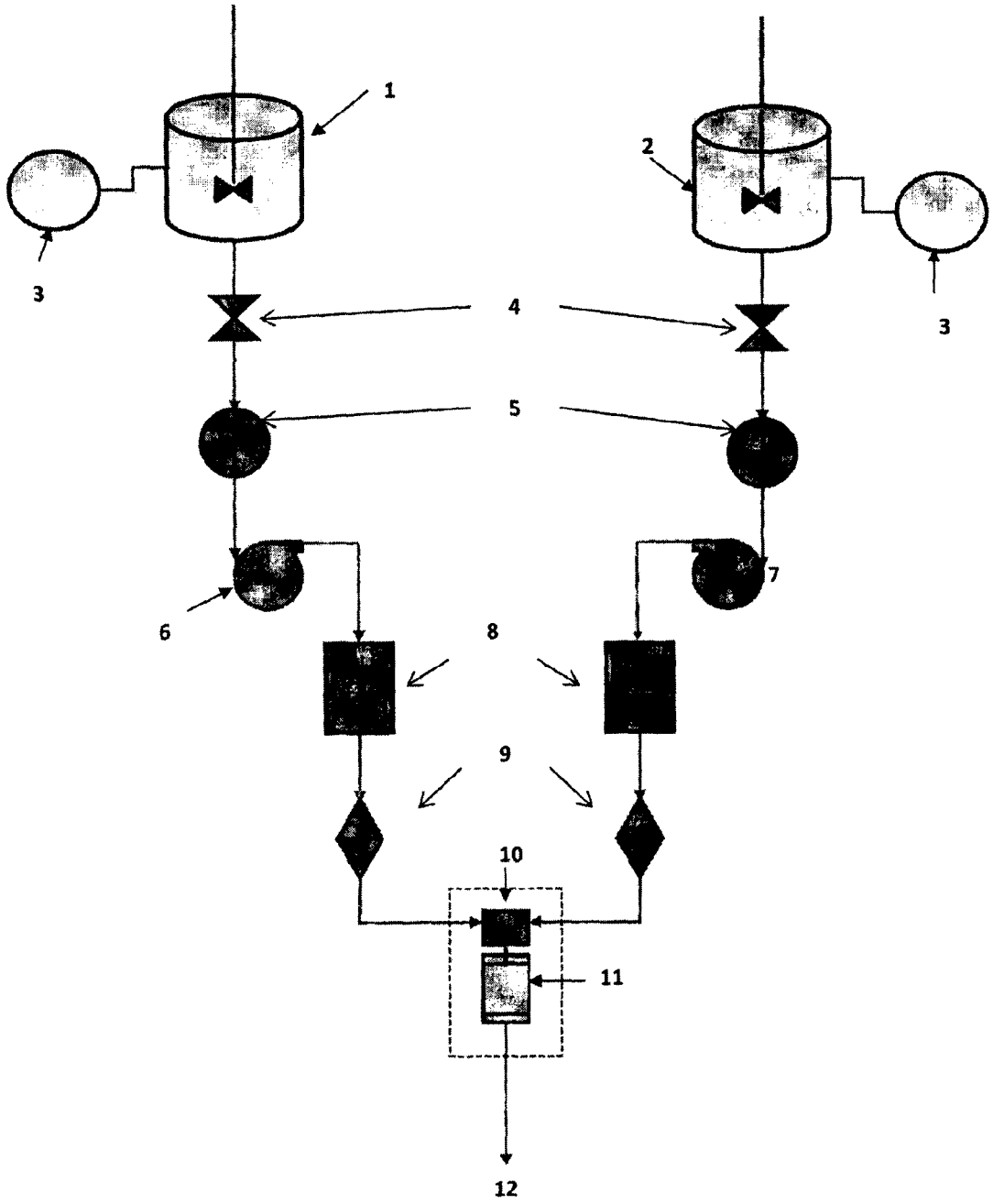
FIGS. 1 and 2 are schematics illustrating implementation of embodiments of the present invention.
Figure 2:
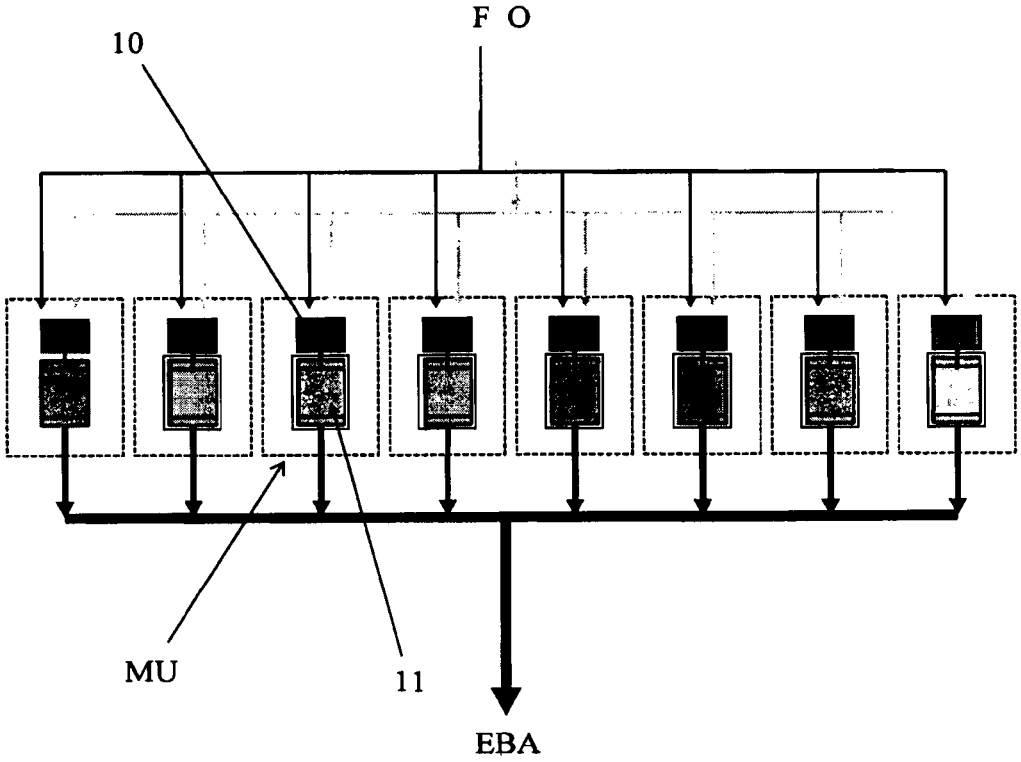

FIG. 2 shows a multiple star laminator pre-mixers (10) and micro-orifice mixers (11) of the type shown in FIG. 1 arranged in parallel. Each pre-mixer (10) is supplied with fuel blend (F) and oxidizer salt solution (0) through supply lines (the associated valves, filters, metering components etc are not shown). The output of each pre-mixer (10) is delivered directly to a micro-orifice-mixer (11) being combined as a single stream of emulsion (EBA).

Figure 3:
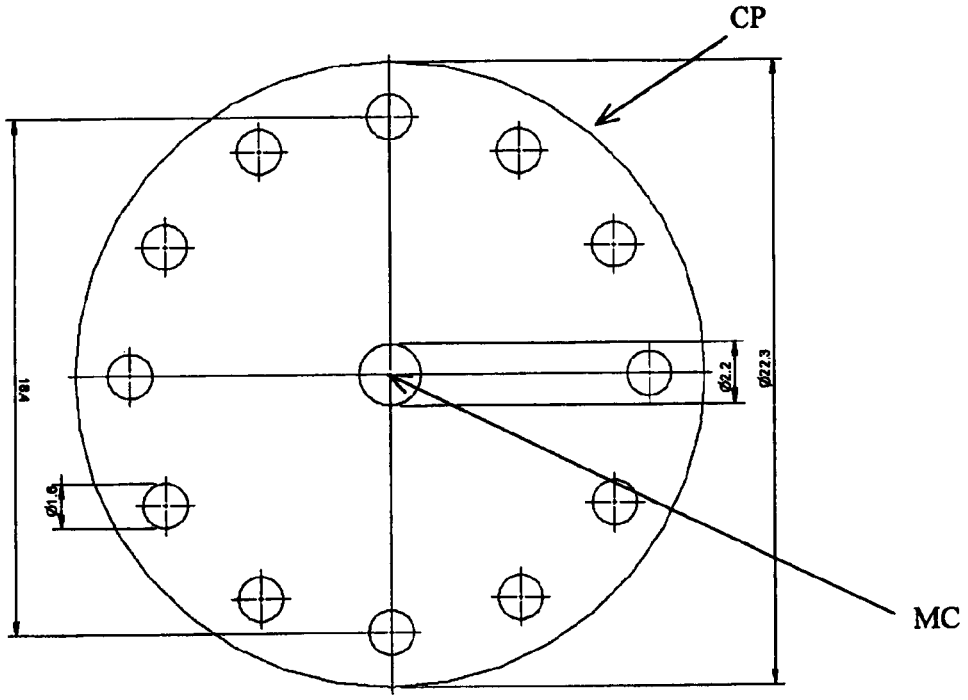
FIG. 3 shows the type of foils making up a star laminator mixer.
Figure 3:
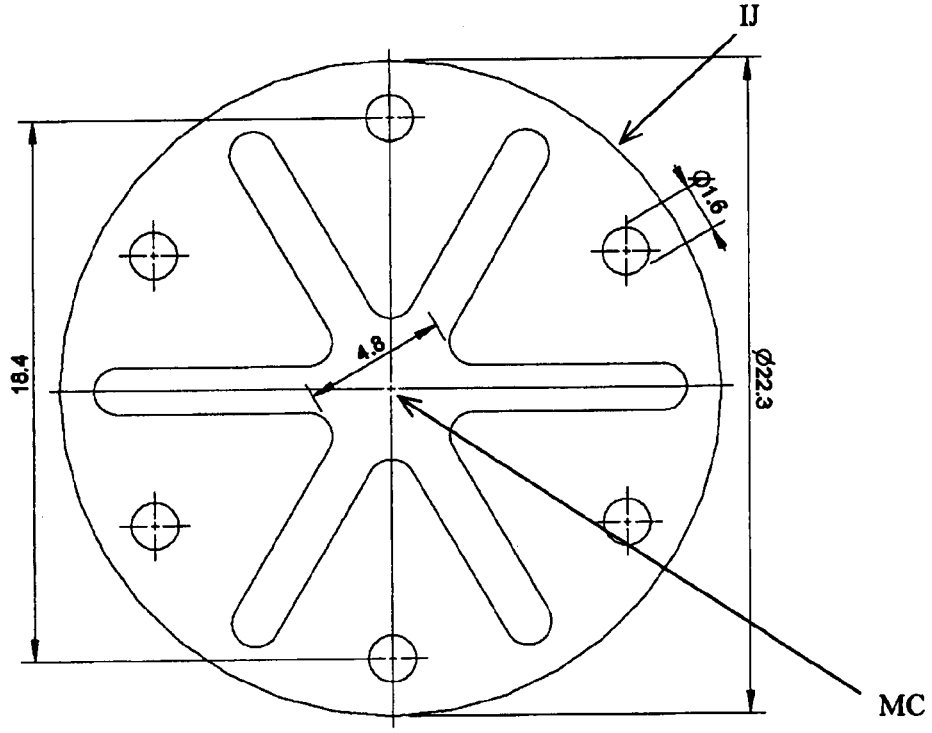

FIG. 3 shows the basic design of foils that may be employed in a star laminator mixer. The foils are identified as a capping foil (CP) and an injection foil (IJ). These two types of foil are stacked interdigitally in an alternating sequence with the body of the mixer to allow a predetermined mixing ratio of oxidizer solution (OX) and fuel blend (FB) to be injected into the mixing channel (MC). The order in which the foils are stacked influences the mixing ratio. For example, to achieve a 1:1 ratio of components to be mixed the sequence of foils will have the repeat unit CP/IJ-FB/CP/IJ-OX/CP until some 125/250 foils are stacked. To achieve a ratio of OX:FB of 2:1 the number of foils for injection of oxidizer solution will be twice the number for injection of fuel blend. In this case the sequence in the stack would have the repeat unit CP/IJ-FB/CP/IJ-OX/CP/IJ-OX/CP until some 125/250 foils are stacked.

Figure 4:
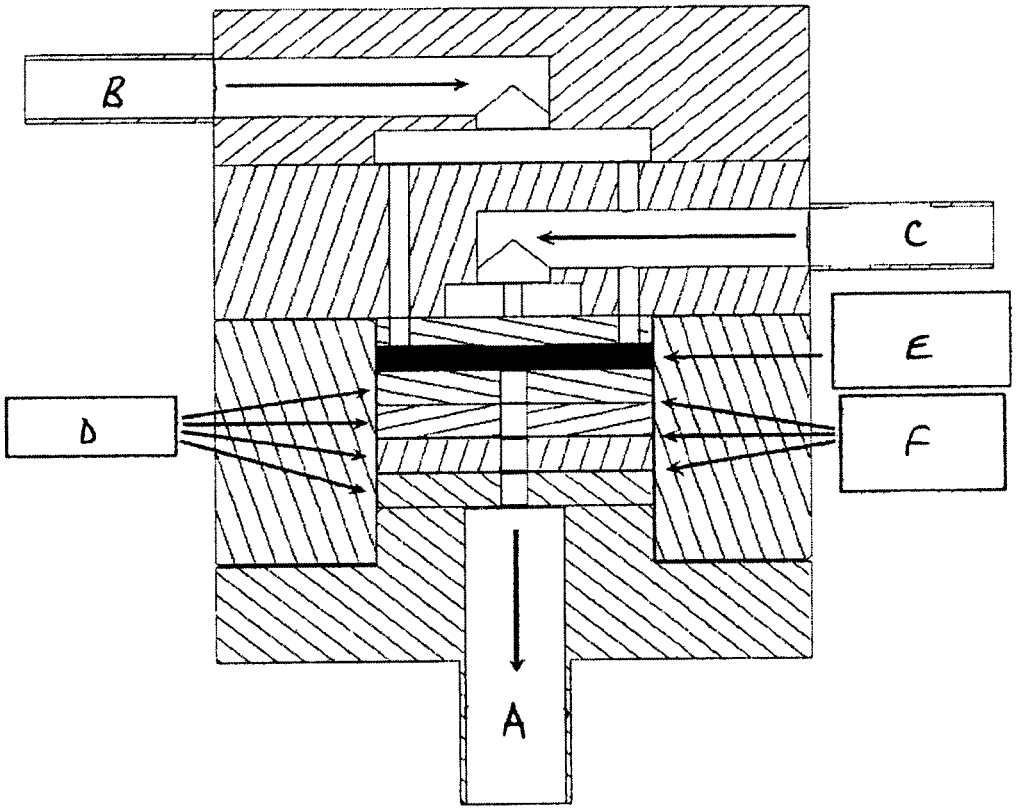
FIG. 4 is a simple diagram showing the basic structural features of a star laminator mixer.

FIG. 4 shows the basic arrangement of components in the star laminator mixer, with the stack being constructed from individual foils. The output of the star laminator mixer is a precursor material and this exits the mixer from an emulsion product outlet (A). By way of example, the mixer may be the commercially available Star Laminator 30 model (IMM). This comprises a stack of stainless steel microstructured foils, each having a thickness of 25 μm. Each foil has micron size channels. A total of 100-260 foils are stacked on top of each other in a steel housing. The stack arrangement channels the fuel blend and oxidizer solution into a main mixing channel in the middle of the stack arrangement. In FIG. 4B represents the fuel blend inlet, C represents the oxidizer solution inlet, D represents spacers, E represents stainless steel foil stacks and F represents foils with orifices separated by spacers.

Figure 5:
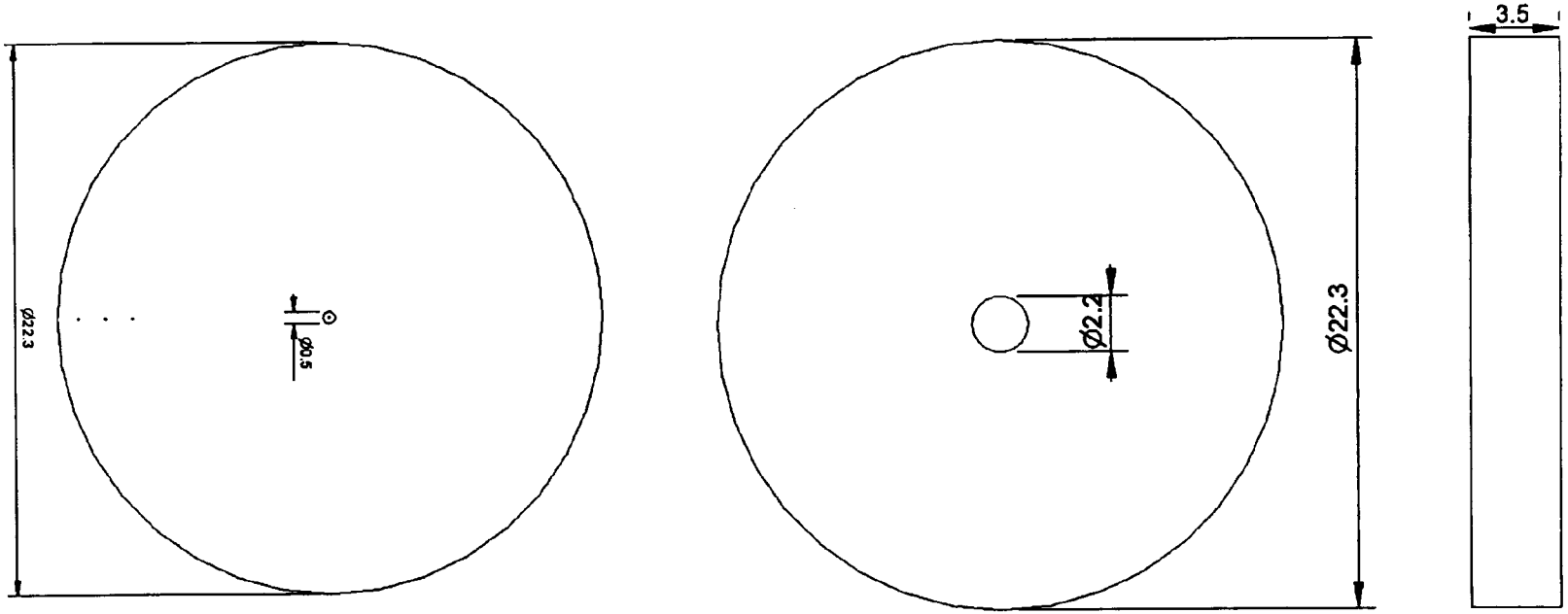
FIG. 5 shows the types of foils used in a micro-orifice mixer.

FIG. 5 shows the basic design of foils that may be used in a micro-orifice mixer. In use this mixer will receive the precursor material produced by the star laminator mixer shown in FIG. 4. The foils are of three designs. One foil is 22.3 mm in diameter, 25 μm in thickness and has a 500 μm diameter orifice. The other foils are 22.3 mm in diameter, 3.5 mm and 7 mm thick and have a 2.2 mm diameter orifice. A stack of these foils always starts with the 500 μm diameter orifice foil to further mix the precursor material immediately to minimize/avoid phase separation. By varying the number of orifices (one only shown in the foils in FIG. 5), orifice diameter, foil thickness and the flow rate of emulsion delivered to the stack, the droplet size and distribution of the emulsion can be controlled. A typical arrangement for the 500 μm and 2.2 mm (2200 μm) diameter orifice foils may be 500-2200 (7 mm)-500-2200 (3.5 mm)-500-2200 (3.5 mm)-500

No additional pumping is usually required from the outlet of the Star Laminator mixer to ensure suitable flow through the micro-orifice mixer.

Embodiments of the present invention are illustrated with reference to the accompanying non-limiting examples.

Once formed in accordance with the invention the intermediate emulsion can be used in conventional manner. Prior to use the intermediate emulsion must be sensitised and usual techniques may be employed here. In these respects the intermediate emulsion is intended to have the same characteristics and behave in the same way as an intermediate emulsion produced in conventional manner.

Emulsion Experimental Rig Flow Diagram

Experimental samples were produced in a specially designed emulsion experimental rig (continuous emulsion micromixing unit). This figure shows a Star Laminator mixer feeding into a Micro-orifice mixer. In control examples reported below, the experimental rig did not include the Micro-orifice mixer, but otherwise the rig design was the same.

The experimental rig comprises fuel blend and oxidiser solution holding tanks with stirrers, filters, gear metering pumps and Corialis mass flow meters in order to allow control of the experimental processes. The rig also has hot water heaters for heating of the holding tanks, and temperature and pressure indicators and pipe heat insulation. Gear pumps drive the fluid streams through the experimental micro mixers. The emulsion experiments and their processes were controlled through a Lab view-based program that is installed on a PC.

Experimental Procedures

The oxidizer solution used in the experiment are prepared by dissolving the oxygen releasing materials in water at a temperature above the crystallizing point of the solution, preferably at a temperature in the range from 25 deg C. to 130 deg C. to give aqueous oxidizer solutions.

The water-immiscible organic fuel used in the experiment forms the continuous oil phase of the water in oil emulsion and also acts as a fuel in the explosive emulsion. For the purpose of demonstrating the invention we have selected for our examples suitable fuel materials like diesel oil, paraffin oil, mineral oil, canola vegetable oil and their respective blends. Those fuels are in the liquid state at the formulation operating temperature. However, if necessary the fuels are heated to temperature which may be in the range from 25 deg C. to 90 deg C.

The emulsifier materials utilized in the examples are basically selected from the group of polymeric and conventional type emulsifiers. The polymeric emulsifiers E25/66, E25L and E21/70 T are typical condensation products of Poly-alkenyl succinic acid or anhydride with primary amines. The typical conventional emulsifier used in our examples was selected from the group of the sorbitan esters. The sorbitan mono-oleate (SMO) was used in our formulations.

For the purpose of the continuous process a fuel blend comprising of the water immiscible fuel and the emulsifier was prepared to allow a single stream in-process metering of a continuous oil phase. The fuel blend is a micellar solution of emulsifier in an oil phase.

In the continuous emulsion micromixing unit the process rapidly combines aqueous oxidizer solution with a blend of water immiscible organic fuel and the emulsifier. The materials are rapidly mixed and the uniform and stable emulsion is formed.

The preparation procedure for the oxidizer solution and the fuel blend were the same as procedures that are normally used in the manufacturing emulsions. The oxidizer solution and the fuel blend were transferred into respective holding tanks and heated to process temperatures 80 to 90° C. and 40 to 50° C., respectively. The oxidizer solution and the fuel blend were continuously metered into the experimental mixing rig in the mass ratios between 92 to 98% oxidiser and 8 to 2% fuel blends.

Experimental data were collected during and at the end of each experiment, including process flow rate, oxidizer solution and fuel blend pump pressure, oxidizer and fuel blend mixer pressure, oxidizer and fuel blend mass flow meter temperature and micro-mixer outlet pressure. The final emulsion viscosity and the emulsion droplets size distribution were also measured.

Viscosity and Droplet Size Measurement Procedures

The emulsion viscosity produced by the emulsion testing rig was measured using a RVT model Brookfield Viscometer utilizing spindle number 3, 4 or 7 depending on the viscosity of the sample. The sample temperature was usually between 20° C. to 70° C. at the time of measurement.

The emulsion droplet size and its distribution were measured by taking pictures of droplets using a light microscope and analysing them using in-house Emulsion Droplet Size Analysis (EDSA) software. When the large droplets (>50 mm) were observed, a Howard Cell was used to contain the sample when pictures were captured, thereby avoiding squashing of the droplets. The pictures were then analysed using a "manual ruler" available within the EDSA software. If small droplets were observed, standard micrograph sample glass was used when taking droplet pictures and they were analysed automatically by the algorithm of the EDSA software. The average, median and standard deviation of the droplets diameter were calculated.

Example 1 (Control)

The mixing process in Example 1 utilized commercial device the Star Laminator—V2.3-30/300 micromixer. The mixer operates on the principle of multilamination using mixing channels with the foil thickness of 25 μm. A total of 125 foils were used in this example. The oxidizer to fuel blend feeding ratio into the micromixer unit was set at 1:1.

TABLE 1

| Component | Oxidizer (%) | Component | Fuel Blend (%) |
|---|---|---|---|
| CPAN | 70.00 | Diesel oil | 76 |
| Water | 29.73 | E25/66T | 24 |
| Acetic Acid | 0.18 | | |
| Thiourea | 0.05 | | |
| Soda Ash | 0.04 | | |
| Total | 100.0 | Total | 100 |

TABLE 1-continued

| | Values |
|---|---|
| Process parameters | |
| Phase Ratio (w/w %) | |
| Oxidizer solution | 92.4% |
| Fuel blend | 7.6% |
| Pressure drop across mixer | |
| Oxidiser solution feed | 1.1 bar |
| Fuel blend feed | 0.5 bar |
| Line Temperature | |
| Oxidiser solution feed | 80° C. |
| Fuel blend feed | 50° C. |
| Sample | 62° C. |
| Total Flow Rate | 100 g/min |
| Sample characteristics | |
| Droplet size range | N/A |
| Brookfield Viscosity @ spindle No3, 50 pm | 1,130 cP |
| Material description | Multiphase fluid |

In the formulation of Example 1, the amount of ammonium nitrate in the oxidizer solution was slightly reduced in order to lower the crystallization point of the solution. The oxidizer solution was maintained at 80° C., while the fuel blend was heated to only 50° C. with the view to assist emulsion formation.

The experiment above has shown that a highly unstable dispersion of oxidizer phase in the fuel blend has been formed. Because of the incomplete emulsion formation and its subsequent break down within a relatively short time the viscosity of the sample was taken within 1 minute of mixing to allow reading of the instrument values.

This example clearly shows that Star Laminator-V2.3-30/300 micromixer can not form a stable emulsion. The failure to form stable emulsion is due to the fact that there is only a limited mixing energy available as shown by a relatively low pressure drop across the Star Laminator mixer. The pressure drop across the unit for both lines is also a function of volumetric flow rates, phase ratio of components, liquid density and viscosity.

Example 2 (Control)

As in the previous example, the mixing process in Example 2 utilized the same commercial device the Star Laminator-V2.3-30/300. The mixer operates on the principle of multilamination using mixing channels with the foil thickness of 25 μm. A total of 125 of foils were also used in this example. However, the oxidiser to fuel blend feeding ratio into the micromixer unit was set at 2:1.

TABLE 2

| Component | Oxidizer (%) | Component | Fuel Blend (%) |
|---|---|---|---|
| CPAN | 70.00 | Diesel oil | 76 |
| Water | 29.73 | E25/66T | 24 |
| Acetic Acid | 0.18 | | |
| Thiourea | 0.05 | | |
| Soda Ash | 0.04 | | |
| Total | 100.0 | Total | 100 |

TABLE 2-continued

| | Values |
|---|---|
| Process parameters | |
| Phase Ratio (w/w %) | |
| Oxidizer solution | 92.4% |
| Fuel blend | 7.6% |
| Pressure drop across mixer | |
| Oxidiser solution feed | 0.9 bar |
| Fuel blend feed | 1.6 bar |
| Line Temperature | |
| Oxidiser solution feed | 80° C. |
| Fuel blend feed | 50° C. |
| Sample | 60° C. |
| Total Flow Rate | 100 g/min |
| Sample characteristics | |
| Droplet size range | N/A |
| Brookfield Viscosity @ spindle No3, 50 pm | N/A |
| Material description | Heterogeneous dispersion. Immediate breakdown |

In this example, a slightly different configuration of foils in the Star Laminator micromixer was used in an attempt to improve mixing via enhancement of the local velocity of the fuel blend by halving the number of injection channels for the blend. This action caused an increase of the pressure drop across the fuel blend line as indicated in table 2 above.

The material produced in this example was a highly unstable dispersion of oxidizer in the fuel blend, which started to phase separate almost immediately after collection. The viscosity of the sample was not taken due to the fact that the sample, upon collection have phase separated.

Example 3 (Control)

The mixing process in Example 3 utilized the same commercial device "the Star Laminator-V2.3-30/300 as Example 1. The mixer operates on the principle of multilamination using mixing channels with the foil thickness of 25 μm. However, a total of 250 foils were used in the Star Laminator mixer. The oxidizer to fuel blend feeding ratio into the micromixer unit was set at 1:1.

TABLE 3

| Component | Oxidizer (%) | Component | Fuel Blend (%) |
|---|---|---|---|
| CPAN | 70.00 | Diesel oil | 76 |
| Water | 29.73 | E25/66T | 24 |
| Acetic Acid | 0.18 | | |
| Thiourea | 0.05 | | |
| Soda Ash | 0.04 | | |
| Total | 100.0 | Total | 100 |

| | Values |
|---|---|
| Process parameters | |
| Phase Ratio (w/w %) | |
| Oxidizer solution | 92.4% |
| Fuel blend | 7.6% |
| Pressure drop across mixer | |
| Oxidiser solution feed | 0.4 bar |
| Fuel blend feed | 0.4 bar |

TABLE 3-continued

| | |
|---|---|
| Line Temperature | |
| Oxidiser solution feed | 80° C. |
| Fuel blend feed | 50° C. |
| Sample | 55° C. |
| Total Flow Rate | 100 g/min |
| Sample characteristics | |
| Droplet size range | N/A |
| Brookfield Viscosity @ spindle No3, 50 pm | 1,450 cP |
| Material description | Multiphase fluid Phase separation & break down |

In Example 3 the number of foils in the Star Laminator micromixer was doubled when it is compared with the foil configuration used in Example 1. The foils configuration was changed to obtain reduction in local velocity of the fuel and oxidizer fluid streams as they are injected into the mixing channel in the Star Laminator mixer.

It is believed that lowering of the local velocities (i.e. lower local volumetric flow rates) of the streams leads to formation of thinner lamellae of the fuel blend and oxidizer solution as the lamellae are contacted in the Star Laminator's mixing channel. Hence, it was expected that the larger number of foils would cause formation of a finer dispersion of oxidizer solution in the continuous fuel blend.

However, the Example 3 clearly failed to produce material of improved stability and viscosity. This is because of the incomplete emulsion formation and its subsequent break down within a relatively short time, the viscosity of the sample was taken within 1 minute of mixing to allow reading of the instrument values.

Experimental set up of the mixing processes in Examples 1, 2 and 3 suggests that stability of the emulsion material is not achieved because of the insufficiency of the diffusion mixing within the Star Laminator micromixer. It seems that conversion of flow energy into shear energy and turbulent mixing is needed in order to achieve the required dispersion of oxidiser droplets and emulsifier molecules.

Example 4

The Example 4 material was prepared following the general mixing procedures of Example 1, except that the precursor material was taken directly from the outlet of the Star Laminator micromixer and conducted to an inlet of the Micro-orifice mixer.

The Micro-orifice mixer is constructed of 4 repeat units consisting of: 1× unit of 500 μm diameter×50 μm thick orifice, 2× units of 2.2 mm diameter×3.5 mm thick orifices (channels) and 1× unit of 2.2 mm diameter×7 mm thick orifices (channels). The oxidizer to fuel blend feeding ratio into the Star Laminator mixer was maintained at 1:1.

TABLE 4

| Component | Oxidizer (%) | Component | Fuel Blend (%) |
|---|---|---|---|
| CPAN | 70.00 | Diesel oil | 76 |
| Water | 29.73 | E25/66T | 24 |
| Acetic Acid | 0.18 | | |
| Thiourea | 0.05 | | |
| Soda Ash | 0.04 | | |
| Total | 100.0 | Total | 100 |

TABLE 4-continued

| | Values |
|---|---|
| Process parameters | |
| Phase Ratio (w/w %) | |
| Oxidizer solution | 92.4% |
| Fuel blend | 7.6% |
| Pressure drop across mixer | |
| Oxidiser solution feed | 4.3 bar |
| Fuel blend feed | 3.2 bar |
| Line Temperature | |
| Oxidiser solution feed | 80° C. |
| Fuel blend feed | 50° C. |
| Sample | 55° C. |
| Total Flow Rate | 125 g/min |
| Sample characteristics | |
| Droplet size range | 6-24 μm |
| Brookfield Viscosity @ spindle No7, 50 rpm | 10,560 cP |
| Material description | Good quality emulsion |

In Example 4, the Micro-orifice mixer further mixed the precursor material by converting the flow energy into the shear energy that enabled it to reduce the size of oxidizer solution droplets in the fuel blend. In addition, the Micro-orifice mixer allowed more efficient dispersion and hence the use of the emulsifier in stabilizing the newly formed oxidizer droplet surfaces.

It is observed that more energy is used in the Micro-orifice process than in the Star Laminator. This fact is clearly reflected in the higher pressure drop across the unit for both oxidizer solution and fuel blend feeds when comparison is made to the pressure drop across the Star Laminator micromixer unit in Example 1.

Pressure drop across the unit for both lines is also a function of volumetric flow rates, phase ratio of components, liquid density and viscosity.

The material produced in Example 4 was a stable emulsion with a Brookfield viscosity of 10,560 cP (spindle #7, 50 rpm). The viscosity measurement was taken within 1 minute of its formation at sample temperature of 55° C. The size of the oxidizer solution droplet was measured using an optical microscope within 24 hours of its collection. Analysis of the droplet pictures showed that the size distribution of the droplets was a normal distribution function with an average size of 15 μm and standard deviation of 10 μm. Sample was a good quality water-in-oil emulsion that was not phase separating for at least 90 days.

Example 5

Example 5 was performed following the mixing procedures of Example 2, with an exception that the precursor material was taken directly from the outlet of the Star Laminator mixer and conducted to an inlet of the Micro-orifice mixer as used previously in the Example 4. The oxidizer solution to fuel blend feeding ratio into the Star Laminator unit was maintained at 2:1.

TABLE 5

| Component | Oxidizer (%) | Component | Fuel Blend (%) |
|---|---|---|---|
| CPAN | 70.00 | Diesel oil | 76 |
| Water | 29.73 | E25/66T | 24 |
| Acetic Acid | 0.18 | | |
| Thiourea | 0.05 | | |
| Soda Ash | 0.04 | | |
| Total | 100.0 | Total | 100 |

| | Values |
|---|---|
| Process parameters | |
| Phase Ratio (w/w %) | |
| Oxidizer solution | 92.4% |
| Fuel blend | 7.6% |
| Pressure drop across mixer | |
| Oxidiser solution feed | 4.2 bar |
| Fuel blend feed | 3.7 bar |
| Line Temperature | |
| Oxidiser solution feed | 80° C. |
| Fuel blend feed | 50° C. |
| Sample | 55° C. |
| Total Flow Rate | 125 g/min |
| Sample characteristics | |
| Droplet size range | 10-32 μm |
| Brookfield Viscosity @ spindle No7, 50 pm | 10,800 cP |
| Material description | Good quality emulsion |

TABLE 6

| Component | Oxidizer (%) | Component | Fuel Blend (%) |
|---|---|---|---|
| CPAN | 75.00 | Diesel oil | 43.2 |
| Water | 24.73 | Canola oil | 43.2 |
| Acetic Acid | 0.22 | E25/66T | 13.6 |
| Thiourea | 0.025 | | |
| Soda Ash | 0.025 | | |
| Total | 100.0 | Total | 100 |

| | Values |
|---|---|
| Process parameters | |
| Phase Ratio (w/w %) | |
| Oxidizer solution | 92.4% |
| Fuel blend | 7.6% |
| Pressure drop across mixer | |
| Oxidiser solution feed | 4.2 bar |
| Fuel blend feed | 3.1 bar |
| Line Temperature | |
| Oxidiser solution feed | 80° C. |
| Fuel blend feed | 50° C. |
| Sample | 57° C. |
| Total Flow Rate | 125 g/min |
| Sample characteristics | |
| Droplet size range | 5.6-23.6 μm |
| Brookfield Viscosity @ spindle No7, 50 pm | 15,600 cP |
| Material description | Excellent quality emulsion |

As demonstrated in the Example 5 the Micro-orifice mixer further mixed the precursor material by converting the flow energy into the shear energy that enabled to reduce the size of oxidizer solution droplets in the fuel blend. Moreover, the Micro-orifice process allowed more efficient dispersion and hence the use of the emulsifier in stabilizing the newly formed oxidizer droplet surfaces.

It is clear that more energy is used in the Micro-orifice process than in the Star Laminator. This fact is reflected in the higher pressure drop across the unit for both oxidizer solution and fuel blend feeds if comparison is made to the pressure drop across the Star Laminator micromixer in Example 2.

Pressure drop across the unit for both lines is also a function of volumetric flow rates, phase ratio of components, liquid density and viscosity.

The material produced in this example was a good quality stable emulsion with a Brookfield viscosity of 10,800 cP (spindle #7, 50 rpm) similar to Example 4. The viscosity measurement was taken within 1 minute of emulsion formation at sample temperature of 55° C. The size of the oxidizer solution droplets was measured using an optical microscope within 24 hours of the sample collection. Analysis of the droplet pictures showed that the size distribution of the droplets was a normal distribution function with average size of 21 μm and standard deviation of 11 μm. The sample material was a good quality water-in-oil emulsion that was not phase separating for at least 90 days.

Example 6

The experiment in Example 6 was following the mixing procedures that were used in Example 4, however modified oxidizer and fuel blend formulation was employed (Table 6). The oxidizer to fuel blend feeding ratio into the Star Laminator pre-mixer unit was maintained at 1:1.

The same Star Laminator micromixer and Micro-orifice mixer combination was used as in Example 4.

The experimental work has shown that the Micro-orifice mixer can be employed to produce good quality emulsion when different formulations of oxidizer solution and fuel blend are used. The oxidizer solution used in this work has higher content of ammonium nitrate which made the solution slightly more viscous and of a higher density when compared to oxidizer solution used in Example 4. The fuel blend comprised of diesel oil, canola oil and emulsifier and as such the blend was more viscous due the addition of canola oil.

The conversion of flow energy into mixing in the Micro-orifice mixer was as efficient as in Example 4. This is reflected in the similar pressure drop across the unit for both oxidizer solution and fuel blend feeds. Pressure drop across the unit for both lines is a function of volumetric flow rates, phase ratio of components, liquid density and viscosity.

The material produced in Example 6 was a stable emulsion with a Brookfield viscosity of 15,600 cP (spindle #7, 50 rpm) that was more viscous than the emulsion made in example 4. The higher emulsion viscosity is mainly reflexion of a more viscous fuel blend used in this example. The viscosity measurement was taken within 1 minute of its formation at sample temperature of 57° C. The size of the oxidizer solution droplets was measured using an optical microscope within 24 hours of its collection. Analysis of the droplet pictures showed that the size distribution of the droplets was a normal distribution function with average size of 15 μm and standard deviation of 9 μm. The sample was an excellent water-in-oil emulsion that was not phase separating for at least 90 days.

Example 7

The experiment in Example 7 followed mixing procedures that were used in Example 5; however, the oxidizer and fuel blend were modified as shown in table 7 below. The oxidizer to fuel blend feeding ratio into the pre-mixer unit was maintained at 2:1.

TABLE 7

| Component | Oxidizer (%) | Component | Fuel Blend (%) |
|---|---|---|---|
| CPAN | 75.00 | Diesel oil | 43.2 |
| Water | 24.73 | Canola oil | 43.2 |
| Acetic Acid | 0.22 | E25/66T | 13.6 |
| Thiourea | 0.025 | | |
| Soda Ash | 0.025 | | |
| Total | 100.0 | Total | 100 |

| | Values |
|---|---|
| Process parameters | |
| Phase Ratio (w/w %) | |
| Oxidizer solution | 92.4% |
| Fuel blend | 7.6% |
| Pressure drop across mixer | |
| Oxidiser solution feed | 4.0 bar |
| Fuel blend feed | 3.5 bar |
| Line Temperature | |
| Oxidiser solution feed | 80° C. |
| Fuel blend feed | 50° C. |
| Sample | 60° C. |
| Total Flow Rate | 125 g/min |
| Sample characteristics | |
| Droplet size range | 5.3-25.3 μm |
| Brookfield Viscosity @ spindle No7, 50 pm | 16,800 cP |
| Material description | Excellent quality emulsion |

The experimental work has shown that the Micro-orifice mixer can be employed to produce good quality emulsion when different formulations of oxidizer solution and fuel blend are used.

The conversion of flow energy into mixing in the micro-orifice mixer was as efficient as in Example 5, as reflected in the similar pressure drop across the unit for both oxidiser solution and fuel blend feeds.

The material produced in Example 7 was a stable emulsion with a Brookfield viscosity of 16,800 cP (spindle #7, 50 rpm) that was more viscous than the Example 5. The higher emulsion viscosity is mainly an attribute of a more viscous fuel blend used in this example. The viscosity measurement was taken within 1 minute of its formation at sample temperature of 60° C. The size of the oxidizer solution droplet was then measured using an optical microscope within 24 hours of its collection. Analysis of the droplet pictures showed that the size distribution of the droplets was a normal distribution function with average size of 15 μm and standard deviation of 9 μm. The sample was a quality water-in-oil emulsion that was not phase separating for at least 90 days.

Example 8

The experiment in Example 8 was following the mixing procedures that were used in Example 4, however modified fuel blend formulation was employed (Table 8). The oxidizer to fuel blend feeding ratio into the Star Laminator pre-mixer unit was maintained at 1:1.

TABLE 8

| Component | Oxidizer (%) | Component | Fuel Blend (%) |
|---|---|---|---|
| CPAN | 75.00 | Mineral oil | 50.0 |
| Water | 24.70 | Canola oil | 35.7 |
| Acetic Acid | 0.18 | E25/66T | 14.3 |
| Thiourea | 0.10 | | |
| Soda Ash | 0.02 | | |
| Total | 100.0 | Total | 100 |

| | Values |
|---|---|
| Process Parameters | |
| Phase Ratio (w/w %) | |
| Oxidizer solution | 93.0% |
| Fuel blend | 7.0% |
| Pressure drop across mixer | |
| Oxidiser solution feed | 4.5 bar |
| Fuel blend feed | 3.6 bar |
| Line Temperature | |
| Oxidiser solution feed | 80° C. |
| Fuel blend feed | 50° C. |
| Sample | 55° C. |
| Total Flow Rate | 125 g/min |
| Sample characteristics | |
| Droplet size range | Not measured |
| Brookfield Viscosity @ spindle No7, 50 pm | 19,200 cP |
| Material description | Excellent quality emulsion |

The experimental work has shown that the Micro-orifice mixer can be employed to produce good quality emulsion when different formulations of oxidizer solution and fuel blend are used.

The conversion of flow energy into mixing in the micro-orifice mixer was as efficient as in Example 4, as reflected in the similar pressure drop across the unit for both oxidizer solution and fuel blend feeds.

The oxidizer solution used in this example was the same as the ones used in Example 6 and 7 while the fuel blend was more viscous than the fuel blends in Examples 6 and 7.

The material produced in the Example 8 was a stable emulsion with a Brookfield viscosity of 19,200 cP (spindle #7, 50 rpm) that was more viscous than the sample shown in Examples 6 and 7. The higher emulsion viscosity was attributable to a more viscous fuel blend and the higher oxidiser solution to fuel blend ratio in the emulsion.

The viscosity measurement was taken within 1 minute of its formation at sample temperature of 55° C. Sample was an excellent water-in-oil emulsion that was not phase separating for at least 90 days.

Example 9

The experiment in Example 9 followed mixing procedures that were used in Example 5, however, the oxidizer and fuel blend were modified as shown in table 9 below.

The oxidizer to fuel blend feeding ratio into the pre-mixer unit was maintained at 2:1.

TABLE 9

| Component | Oxidizer (%) | Component | Fuel Blend (%) |
|---|---|---|---|
| CPAN | 75.00 | Mineral oil | 50.0 |
| Water | 24.70 | Canola oil | 35.7 |

TABLE 9-continued

| | | | |
|---|---|---|---|
| Acetic Acid | 0.18 | E25/66T | 14.3 |
| Thiourea | 0.10 | | |
| Soda Ash | 0.02 | | |
| Total | 100.0 | Total | 100 |

| | Values |
|---|---|
| Process parameters | |
| Phase Ratio (w/w %) | |
| Oxidizer solution | 93.0% |
| Fuel blend | 7.0% |
| Pressure drop across mixer | |
| Oxidiser solution feed | 4.5 bar |
| Fuel blend feed | 3.9 bar |
| Line Temperature | |
| Oxidiser solution feed | 80° C. |
| Fuel blend feed | 50° C. |
| Sample | 55° C. |
| Total Flow Rate | 125 g/min |
| Sample characteristics | |
| Droplet size range | Not measured |
| Brookfield Viscosity @ spindle No7, 50 pm | 21,600 cP |
| Material description | Excellent quality emulsion |

The experimental work has shown that the Micro-orifice mixer can be employed to produce good quality emulsion when different formulations of oxidizer solution and fuel blend are used.

The conversion of flow energy into mixing in the micro-orifice mixer was as efficient as in Example 5, reflected in the similar pressure drop across the unit for both oxidizer solution and fuel blend feeds.

The material produced in Example 9 was a stable emulsion with a Brookfield viscosity of 21,600 cP (spindle #7, 50 rpm). It is more viscous than the emulsion in Examples 6 and 7. The higher emulsion viscosity was attributable to a more viscous fuel blend and the higher oxidiser solution to fuel blend ratio in the emulsion. The viscosity measurement was taken within 1 minute of its formation at sample temperature of 55° C. Sample was an excellent water-in-oil emulsion that was not phase separating for at least 90 days.

Example 10

The experiment in Example 10 was following the mixing procedures that were used in Example 4, however modified oxidizer and fuel blend formulation was employed (Table 10). The oxidizer to fuel blend feeding ratio into the Star Laminator pre-mixer unit was maintained at 1:1.

TABLE 10

| Component | Oxidizer (%) | Component | Fuel Blend (%) |
|---|---|---|---|
| CPAN | 72.90 | Mineral oil | 50.0 |
| Sodium nitrate | 9.80 | Paraffinic oil | 30.0 |
| Citric acid | 0.30 | E21/70T | 12.0 |
| Water | 17.00 | E25L | 8.0 |
| Total | 100.0 | Total | 100 |

TABLE 10-continued

| | Values |
|---|---|
| Process parameters | |
| Phase Ratio (w/w %) | |
| Oxidizer solution | 94.0% |
| Fuel blend | 6.0% |
| Pressure drop across mixer | |
| Oxidiser solution feed | 4.0 bar |
| Fuel blend feed | 3.0 bar |
| Line Temperature | |
| Oxidiser solution feed | 85° C. |
| Fuel blend feed | 50° C. |
| Sample | 60° C. |
| Total Flow Rate | 125 g/min |
| Sample characteristics | |
| Droplet size range | N/A |
| Brookfield Viscosity @ spindle No7, 50 pm | 19,600 cP |
| Material description | Excellent quality emulsion |

The experimental work has shown that the Micro-orifice mixer can be employed to produce good quality emulsion when different formulations of oxidizer solution and fuel blend are used. In this case an oxidizer solution based on Ammonium Nitrate and Sodium Nitrate was used. Furthermore, also combination of a two different emulsifiers and different oils was employed.

The conversion of flow energy into mixing in the micro-orifice mixer was as efficient as in Example 4 and is reflected in the similar pressure drop across the unit for both oxidizer solution and fuel blend feeds.

The material produced in Example 10 was a stable emulsion with a Brookfield viscosity of 19,600 cP (spindle #7, 50 rpm). The viscosity measurement was taken within 1 minute of its formation at sample temperature of 60° C. Sample was an excellent water-in-oil emulsion that was not phase separating for at least 90 days.

Example 11

The experiment in Example 11 was following the mixing procedures that were used in Example 4, however modified oxidizer, fuel blend and phase ratio of the components was used as per table 11 below. The oxidizer to fuel blend feeding ratio into the Star Laminator pre-mixer unit was maintained at 1:1.

TABLE 11

| Component | Oxidizer (%) | Component | Fuel Blend (%) |
|---|---|---|---|
| CPAN | 72.90 | Canola oil | 35.8 |
| Sodium nitrate | 9.80 | Mineral oil | 27.6 |
| Citric acid | 0.30 | E25/66T | 35.8 |
| Water | 17.00 | Zonyl | 0.18 |
| Total | 100.0 | Total | 100 |

| | Values |
|---|---|
| Process parameters | |
| Phase Ratio (w/w %) | |
| Oxidizer solution | 93.5% |
| Fuel blend | 6.5% |
| Pressure drop across mixer | |
| Oxidiser solution feed | 4.3 bar |
| Fuel blend feed | 3.5 bar |

TABLE 11-continued

| Line Temperature | |
|---|---|
| Oxidiser solution feed | 85° C. |
| Fuel blend feed | 50° C. |
| Sample | 60° C. |
| Total Flow Rate | 110 g/min |
| Sample characteristics | |
| Droplet size range | N/A |
| Brookfield Viscosity @ spindle No7, 50 pm | 15,200 cP |
| Material description | Excellent quality emulsion |

The experimental work has shown that the Micro-orifice mixer can be employed to produce good quality emulsion when different formulations of oxidizer solution and fuel blend are used. In this case an oxidizer solution based on Ammonium Nitrate and Sodium Nitrate was used. Furthermore, also combination of a two different emulsifiers and different oils was employed.

The conversion of flow energy into mixing in the micro-orifice mixer was as efficient as in Example 4 and is reflected in the similar pressure drop across the unit for both oxidizer solution and fuel blend feeds.

The material produced in Example 11 was a stable emulsion with a Brookfield viscosity of 15,200 cP (spindle #7, 50 rpm). The viscosity measurement was taken within 1 minute of its formation at sample temperature of 60° C. Sample was an excellent water-in-oil emulsion that was not phase separating for at least 90 days.

Example 12

The experiment in Example 12 was following the mixing procedures that were used in Example 4, however modified oxidizer, fuel blend and phase ratio of the components was used as per table 12 below. The oxidizer to fuel blend feeding ratio into the Star Laminator pre-mixer unit was maintained at 1:1.

TABLE 12

| Component | Oxidizer (%) | Component | Fuel Blend (%) |
|---|---|---|---|
| CPAN | 77.00 | Canola oil | 35.8 |
| Acetic acid | 0.18 | Mineral oil | 27.6 |
| Thiourea | 0.15 | E25/66T | 35.8 |
| Soda ash | 0.02 | Zonyl | 0.18 |
| Water | 22.65 | | |
| Total | 100.0 | Total | 100 |

| | Values |
|---|---|
| Process parameters | |
| Phase Ratio (w/w %) | |
| Oxidizer solution | 93.5% |
| Fuel blend | 6.5% |
| Pressure drop across mixer | |
| Oxidiser solution feed | 3.4 bar |
| Fuel blend feed | 3.4 bar |
| Line Temperature | |
| Oxidiser solution feed | 80° C. |
| Fuel blend feed | 50° C. |
| Sample | 55° C. |
| Total Flow Rate | 100 g/min |

TABLE 12-continued

| Sample characteristics | |
|---|---|
| Droplet size range | N/A |
| Brookfield Viscosity @ spindle No7, 50 pm | 15,000 cP |
| Material description | Excellent quality emulsion |

The experimental work has shown that the Micro-orifice mixer can be employed to produce good quality emulsion when different formulations of oxidizer solution and fuel blend are used. The oxidizer solution used in this example was mainly comprised of chemically pure ammonium nitrate (77%) and water. The fuel blend comprised of mineral oil, canola oil and emulsifier.

The conversion of flow energy into mixing in the micro-orifice mixer was as efficient as in Example 4 and is reflected in the similar pressure drop across the unit for both oxidizer solution and fuel blend feeds. However, those pressure numbers were also affected by setting the production rate at lower value of 100 g/min.

The material produced in the Example 12 was a stable emulsion with a Brookfield viscosity of 15,000 cP (spindle #7, 50 rpm). The viscosity measurement was taken within 1 minute of its formation at sample temperature of 55° C. Sample was an excellent water-in-oil emulsion that was not phase separating for at least 90 days.

Example 13

The Example 13 was prepared following the mixing procedures of Example 3, with an exception that the precursor material was taken directly from the outlet of the Star Laminator mixer and conducted to an inlet of the Micro-orifice mixer as used previously in the Example 4.

The oxidizer to fuel blend feeding ratio into the Star Laminator unit was maintained at 1:1. Modified oxidizer and fuel blends were used and phase ratio between the two components was also modified.

TABLE 13

| Component | Oxidizer (%) | Component | Fuel Blend (%) |
|---|---|---|---|
| CPAN | 79.70 | Canola oil | 35.8 |
| Acetic acid | 0.18 | Mineral oil | 27.6 |
| Thiourea | 0.15 | E25/66T | 35.8 |
| Soda ash | 0.02 | Zonyl | 0.18 |
| Urea | 1.75 | | |
| Water | 18.25 | | |
| Total | 100.0 | Total | 100.0 |

| | Values |
|---|---|
| Process parameters | |
| Phase Ratio (w/w %) | |
| Oxidizer solution | 94.0% |
| Fuel blend | 6.0% |
| Pressure drop across mixer | |
| Oxidiser solution feed | 2.7 bar |
| Fuel blend feed | 2.4 bar |
| Line Temperature | |
| Oxidiser solution feed | 80° C. |
| Fuel blend feed | 50° C. |
| Sample | 60° C. |
| Total Flow Rate | 100 g/min |
| Sample characteristics | |
| Droplet size range | N/A |
| Brookfield Viscosity @ spindle No7, 50 pm | 16,200 cP |
| Material description | Excellent quality emulsion |

In this example, micro-orifice mixer was also used in combination with Star Laminator micromixer to further mix the water-in-oil dispersion produced by the Star Laminator.

The oxidizer solution used in this example comprised of chemically pure ammonium nitrate (79.7%), urea and water, while the fuel blend comprised of mineral oil, canola oil and emulsifier.

The conversion of flow energy into mixing in the micro-orifice mixer was more efficient in comparison to the previous examples. It was reflected in the lower pressure drop across the unit for both oxidizer solution and fuel blend feeds. However, those pressure numbers were also affected by setting the production rate at lower value of 100 g/min.

The material produced in Example 13 was a stable emulsion with a Brookfield viscosity of 16,200 cP (spindle #7, 50 rpm). The viscosity measurement was taken within 1 minute of its formation at sample temperature of 60° C. Sample was an excellent water-in-oil emulsion that was not phase separating for at least 90 days.

Example 14

Example 14 was performed following the mixing procedures of Example 3, with an exception that the precursor material was taken directly from the outlet of the Star Laminator mixer and conducted to an inlet of the Micro-orifice mixer as used previously in the Example 4. The oxidizer to fuel blend feeding ratio into the Star Laminator unit was maintained at 1:1.

TABLE 14

| Component | Oxidizer (%) | Component | Fuel Blend (%) |
|---|---|---|---|
| CPAN | 79.70 | Canola oil | 35.8 |
| Acetic acid | 0.18 | Mineral oil | 27.6 |
| Thiourea | 0.15 | E25/66T | 35.8 |
| Soda ash | 0.02 | Zonyl | 0.18 |
| Urea | 1.75 | | |
| Water | 18.25 | | |
| Total | 100.0 | Total | 100.0 |

| | Values |
|---|---|
| Process parameters | |
| Phase Ratio (w/w %) | |
| Oxidizer solution | 98.0% |
| Fuel blend | 2.0% |
| Pressure drop across mixer | |
| Oxidiser solution feed | 1.3 bar |
| Fuel blend feed | 1.6 bar |
| Line Temperature | |
| Oxidiser solution feed | 80° C. |
| Fuel blend feed | 50° C. |
| Sample | 60° C. |
| Total Flow Rate | 40 g/min |
| Sample characteristics | |
| Droplet size range | N/A |
| Brookfield Viscosity @ spindle No7, 50 pm | 16,400 cP |
| Material description | Good quality emulsion |

The oxidizer solution and fuel blend used in this example is shown in table 14 above.

In order to test the capability of the Micro-orifice mixer unit to produce stable emulsion, a very high mass phase ratio of the oxidizer solution to fuel blend was selected. It is well known in the art that about 2% continuous organic phase in water in oil emulsion is the practical minimum to allow formation of stable emulsions.

The experiment employed phase ratio of 98% oxidizer solution and 2% fuel blend, which is close to the critical point of a stable w/o emulsion. In the experiment the production flow rates were lowered to 40 g/min in order to increase the residence time of mixing. It has been shown that it is advantageous to select the lower end of the flow rates (from the available flow range) in the micromixer process to ensure formation of stable emulsions, when critical ratios of oxidizer to fuel are used.

The material produced in Example 14 was a stable emulsion with a Brookfield viscosity of 16,400 cP (spindle #7, 50 rpm). The viscosity measurement was taken within 1 minute of its formation at sample temperature of 60° C. A good quality water-in-oil emulsion remained stable for at least 90 days was produced.

Example 15

Example 15 was performed following the mixing procedures of Example 3, with an exception that the precursor material was taken directly from the outlet of the Star Laminator mixer and conducted to an inlet of the Micro-orifice mixer as used previously in the Example 4.

The oxidizer to fuel blend feeding ratio into the Star Laminator unit was maintained at 1:1. Modified oxidizer and fuel blends were used and phase ratio between the two components were also modified as seen in table 15 below.

TABLE 15

| Component | Oxidizer (%) | Component | Fuel Blend (%) |
|---|---|---|---|
| CPAN | 61.70 | Paraffinic oil | 80.00 |
| Calcium nitrate | 19.50 | SMO | 20.00 |
| Water | 18.80 | | |
| Total | 100.0 | Total | 100.0 |

| | Values |
|---|---|
| Process parameters | |
| Phase Ratio (w/w %) | |
| Oxidizer solution | 93.3% |
| Fuel blend | 6.7% |
| Pressure drop across mixer | |
| Oxidiser solution feed | 2.8 bar |
| Fuel blend feed | 1.8 bar |
| Line Temperature | |
| Oxidiser solution feed | 85° C. |
| Fuel blend feed | 50° C. |
| Sample | 63° C. |
| Total Flow Rate | 100 g/min |
| Sample characteristics | |
| Droplet size range | N/A |
| Brookfield Viscosity @ spindle No7, 50 pm | 6,900 cP |
| Material description | Good quality emulsion |

Example 15 has shown that the Micro-orifice mixer unit is capable to produce a high quality emulsion regardless of the oxidizer or fuel materials selection. The oxidizer solution used in this example comprised of chemically pure ammonium nitrate, calcium nitrate and water. The fuel blend comprised of paraffinic oil and emulsifier.

The widely known type emulsifier, the Sorbitan Monooleate was used in this experiment.

The conversion of flow energy into mixing in the micro-orifice mixer was slightly more efficient in comparison to the previous examples. It was reflected in the lower pressure drop across the unit for both oxidizer solution and fuel blend feeds. However, the lower pressure drop in the fuel blend line might be a result of lower viscosity of the fuel blend.

The material produced in Example 15 was a stable emulsion with a Brookfield viscosity of 6,900 cP (spindle #7, 50 rpm). The viscosity measurement was taken within 1 minute of its formation at sample temperature of 63° C. Even though the viscosity of the sample was lower compared to the other example, the sample was a good water-in-oil emulsion that was not phase separating for at least 30 days.

Example 16

Example 16 was performed following the mixing procedures of Example 3, with an exception that the precursor material was taken directly from the outlet of the Star Laminator mixer and conducted to an inlet of the Micro-orifice mixer as used previously in the Example 4. The oxidizer to fuel blend feeding ratio into the Star Laminator unit was maintained at 1:1.

TABLE 16

| Component | Oxidizer (%) | Component | Fuel Blend (%) |
|---|---|---|---|
| CPAN | 75.00 | Paraffinic oil | 63.00 |
| Acetic acid | 0.18 | Canola Oil | 23.00 |
| Thiourea | 0.05 | E25/66T | 14.00 |
| Soda ash | 0.02 | | |
| Water | 24.75 | | |
| Total | 100.0 | Total | 100.0 |

| | Values |
|---|---|
| Process parameters | |
| Metering mass rates | |
| Oxidizer solution | 92.6% |
| Fuel blend | 7.4% |
| Pressure drop across mixer | |
| Oxidiser solution feed | 2.7 bar |
| Fuel blend feed | 2.2 bar |
| Line Temperature | |
| Oxidiser solution feed | 80° C. |
| Fuel blend feed | 50° C. |
| Sample | 60° C. |
| Total Flow Rate | 100 g/min |
| Sample characteristics | |
| Droplet size range | N/A |
| Brookfield Viscosity @ spindle No7, 50 pm | 15,800 cP |
| Material description | Excellent quality emulsion |

Example 16 demonstrates that the Micro-orifice mixer unit can be used to produce good quality emulsion with different formulations of oxidizers and fuels, while also have the phase ratio between the components varied.

The oxidizer solution used in this example comprised of chemically pure ammonium nitrate and water. The fuel blend comprised of paraffinic oil, canola oil and emulsifier.

The conversion of flow energy into mixing in the micro-orifice mixer was as efficient as in previous examples and this is reflected in the similar pressure drop across the unit for the oxidizer solution and fuel blend feeds.

The material produced in this example was a stable emulsion with a Brookfield viscosity of 15,800 cP (spindle #7, 50 rpm). The viscosity measurement was taken within 1 minute of its formation at sample temperature of 60° C. The sample was a good water-in-oil emulsion that was not phase separating for at least 90 days.

The sample was converted into emulsion explosive by sensitizing the intermediate emulsion by adding 6-8 mm diameter polystyrene beads to reduce its density to 0.8 g/cc. Explosive characteristic in terms of velocity of detonation (VOD) was recorded at 2.55 km/sec by employing fibre optic cable and fast timer detection.

The invention claimed is:

1. A process for producing an intermediate emulsion comprising an oxidizer solution, fuel and emulsifier, which comprises the steps of:

(a) mixing in a micromixer an oxidizer solution with a fuel blend comprising a fuel and an emulsifier so as to solubilise a portion of the oxidizer solution in the fuel blend to produce a precursor product;

(b) mixing the precursor product obtained in step (a) using a micromixer in one or more successive stages in order to form the intermediate emulsion, wherein the output of each stage of mixing, and the process as a whole, is 50 to 125 ml/min.

2. The process of claim 1, wherein the dispersed oxidizer phase is selected to control the inherent sensitivity of the intermediate emulsion.

3. The process of claim 1, wherein the residence time for the entire process is from 20 to 100 milliseconds.

4. The process of claim 1, wherein the pressure drop over the process as a whole is less than 20 bar.

5. The process of claim 1, wherein the volume supply rates for the aqueous oxidizer solution and fuel blend respectively are 10 to 250 ml/min and 0.5 to 25 ml/min.

6. The process of claim 1, wherein the intermediate emulsion has a viscosity of at least 6,000 cP (Brookfield viscosity taken with spindle #7 at 50 rpm) at ambient temperature.

7. The process of claim 1, wherein the droplet size of the intermediate emulsion is less than 40 μm.

8. A method for the manufacture of an emulsion explosive which comprises sensitising an intermediate emulsion produced in accordance with the process of claim 1.

* * * * *